US008375853B2

(12) United States Patent
Pohlt

(10) Patent No.: US 8,375,853 B2
(45) Date of Patent: Feb. 19, 2013

(54) TRANSFER UNIT IN AN ELECTROPHORETIC PRINTING OR COPYING APPARATUS

(75) Inventor: Michael Pohlt, Munich (DE)

(73) Assignee: Océ Printing Systems GmbH, Poing (DE)

( * ) Notice: Subject to any disclaimer, the term of this patent is extended or adjusted under 35 U.S.C. 154(b) by 676 days.

(21) Appl. No.: 12/562,195

(22) Filed: Sep. 18, 2009

(65) Prior Publication Data

US 2010/0074660 A1 Mar. 25, 2010

(30) Foreign Application Priority Data

Sep. 19, 2008 (DE) ..... 10 2008 048 047

(51) Int. Cl.
*B41F 7/02* (2006.01)
*G03G 15/16* (2006.01)

(52) U.S. Cl. ..... 101/217; 399/101; 399/249; 399/348

(58) Field of Classification Search ..... 101/217; 399/101, 249, 343, 348, 350, 352, 354
See application file for complete search history.

(56) References Cited

U.S. PATENT DOCUMENTS 7,809,307 B2 * 10/2010 Fukumoto et al. ..... 399/101
2006/0150836 A1 7/2006 Berg et al.
2007/0223980 A1 9/2007 Fukumoto et al.

FOREIGN PATENT DOCUMENTS

JP 2002-132106 5/2002

* cited by examiner

*Primary Examiner* — Hoang Ngo
(74) *Attorney, Agent, or Firm* — Schiff Hardin LLP

(57) ABSTRACT

In a transfer unit, a rotating transfer element is arranged adjacent a charge image carrier that takes toner images from the charge image carrier and supplies the images to a transfer printing station. A scoop element applies carrier fluid to the transfer element. A friction element is provided after the scoop element adjacent to the transfer element at such a distance from the transfer element that a gap between the transfer element and the friction element is substantially completely filled with the carrier fluid, the friction element and the transfer element rotating with different speeds. Residual toner remaining on the transfer element after the transfer printing is loosened by friction forces.

8 Claims, 3 Drawing Sheets

TRANSFER UNIT IN AN ELECTROPHORETIC PRINTING OR COPYING APPARATUS

BACKGROUND

For single- or multicolor printing of a printing substrate (for example a single sheet or a band-shaped recording medium) made of the most varied materials (for example paper or thin plastic or metal films) it is known to generate image-dependent potential images (charge images) on a charge image carrier (for example a photoconductor) that correspond to the images to be printed, comprising regions to be inked and regions that are not to be inked. The regions of the potential images that are to be inked are made visible via toner with a developer station (inking station). The toner image is subsequently printed on the printing substrate.

A liquid developer containing toner and carrier fluid can thereby be used to ink the potential images.

A method for electrophoretic liquid developing (electrographic developing) in digital printing systems is known from, for example, WO 2005/013013 A2 (US 2006/0150836 A1). A carrier fluid containing silicon oil with ink particles (toner particles) dispersed therein is thereby used as a liquid developer. The supply of the liquid developer to the charge image carrier can occur via an applicator roller to which the liquid developer is supplied by a raster roller at which a chamber blade is arranged. The toner images are transferred via a transfer unit from the charge image carrier to the printing substrate. The transfer unit has a transfer element (for example a transfer roller) that transports the toner images to the transfer printing point in a transfer printing station and there interacts with, for example, a corona device in order to transfer the toner images onto the printing substrate. The transfer unit can additionally have a cleaning unit to clean the transfer element, which cleaning unit is realized as a blade, roller or formed fabric or fleece cleaner.

In printers that operate with liquid developer, the cleaning of the transfer element poses increased demands. Since only a little carrier fluid is provided at the transfer printing to the printing substrate for the toner transport to the printing substrate, the danger exists that toner fastens to the transfer element under pressure at the transfer printing point. Due to the small amount of carrier fluid, the danger moreover exists that a relatively large amount of toner remains on the transfer element. This toner (called residual toner of a residual image in the following) must be cleaned off the transfer element before the next transfer of a new print image. Otherwise a shadow image of the previously printed print image is received together with the new print image.

SUMMARY

It is an object to specify a transfer unit for an electrophoretic printing or copying apparatus that is designed so that the residual toner is substantially completely cleaned off of the transfer element after the transfer printing.

In a transfer unit, a rotating transfer element is arranged adjacent a charge image carrier that takes toner images from the charge image carrier and supplies the images to a transfer printing station. A scoop element applies carrier fluid to the transfer element. A friction element is provided after the scoop element adjacent to the transfer element at such a distance from the transfer element that a gap between the transfer element and the friction element is substantially completely filled with the carrier fluid, the friction element and the transfer element rotating with different speeds. Residual toner remaining on the transfer element after the transfer printing is loosened by friction forces.

DESCRIPTION OF THE PREFERRED EMBODIMENTS

Figure 1:
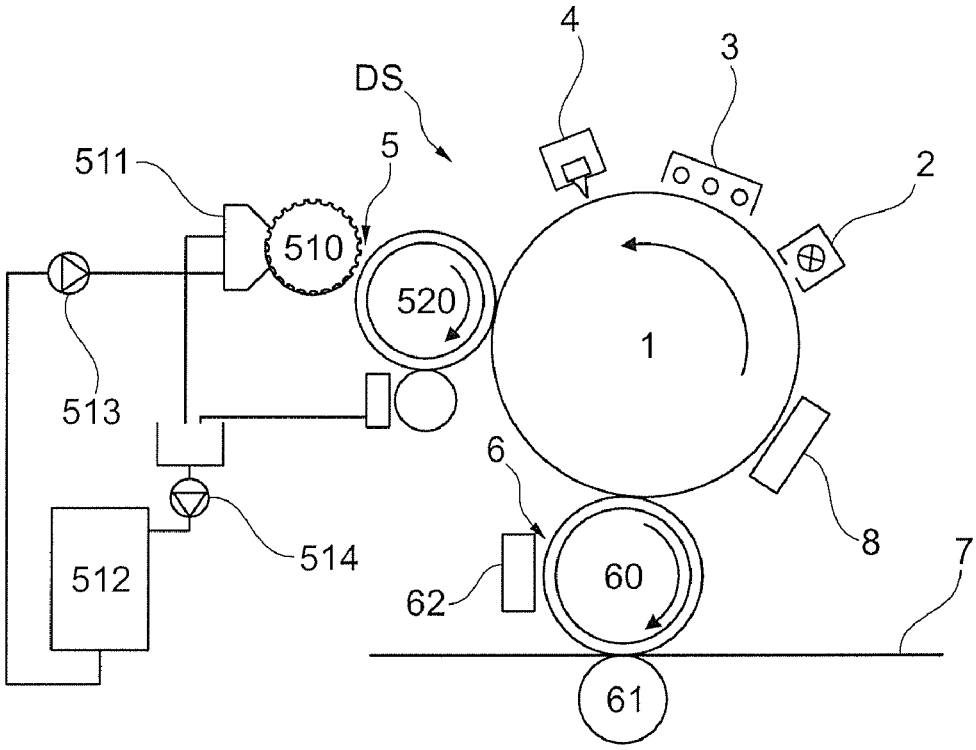
FIG. 1 shows a principle representation of an electrophoretic printing or copying apparatus.

For the purposes of promoting an understanding of the principles of the invention, reference will now be made to the preferred embodiments/best mode illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

A cleaning unit is arranged adjacent to the transfer element that takes toner images from the charge image carrier and supplies these to the transfer printing station for transfer printing onto the printing substrate. The cleaning unit provides:

- a scoop element that applies carrier fluid to the transfer element, which scoop element is situated adjacent to the transfer element after the transfer printing station, and
- a friction element after the scoop element and adjacent to the transfer element, at such a distance from the transfer element that the gap between transfer element and friction element is substantially completely filled with carrier fluid, wherein the friction element and the transfer element rotate with different speeds so that friction forces are transferred to the transfer element via the carrier fluid present between friction element and transfer element, via which friction residual toner of a residual image that remains on the transfer element after the transfer printing are loosened.

If an electrical potential is applied to the friction element, an electrically charged toner can be attracted from the transfer element to the friction element.

It is advantageous when a cleaning element that lies at such an electrical potential that an electrically charged toner is drawn from the transfer element to the cleaning element is arranged after the friction element, adjacent to the transfer element. The cleaning element can therefore be used for cleaning the transfer element in addition to the friction element.

A substantially complete cleaning of residual images from the transfer element is achieved when the friction element is at most as wide as the scoop element and at least as wide as the inking region with toner on the transfer element.

The transfer element, the friction element, the cleaning element and the scoop element can respectively be designed as rotating rollers.

To detach the residual toner from the surface of the transfer roller, friction forces are thus applied by the friction roller via the carrier fluid to the transfer roller, via which the residual toner is loosened. For this it is required that the friction roller rotates with a different surface speed than the transfer roller. A speed gradient in the carrier fluid results via the speed difference of the two rollers, with the consequence that friction forces arise at the surface of the transfer roller.

FIG. 1 shows the components of a printing system DS as it is known from WO 2005/013013 A2 or US 2006/0150836 A1, for example; WO 2005/013013 A2 or US 2006/0150836 A1 is herewith incorporated into the disclosure. A regeneration exposure device 2, a charging station 3, an element for graphical exposure, a developer device 5, a transfer unit 6 for transfer printing of the potential images developed into toner images onto a printing substrate 7 and an element 8 for cleaning the charge image carrier 1 are arranged along a charge image carrier 1 (a photoconductor drum in FIG. 1). The transfer unit 6 possesses a transfer roller 60, a counter-pressure roller 61 and a cleaning unit 62. The developer device 5 is comprised of, for example, an applicator roller 520 which is arranged in contact with the charge image carrier 1. The potential images on the intermediate image carrier 1 are developed with the applicator roller 520. For this the applicator roller 520 supplies a liquid developer (made up of at least a carrier fluid and charged toner) to the charge image carrier 1. The development occurs in a known manner. The liquid developer is, for example, supplied to the applicator roller 520 via a raster roller 510 with cups and webs and a chamber scraper or blade 511 arranged on the raster roller 510, which chamber scraper 511 is connected with a reservoir 510 for liquid developer via pumps 513 and 514.

Figure 2:
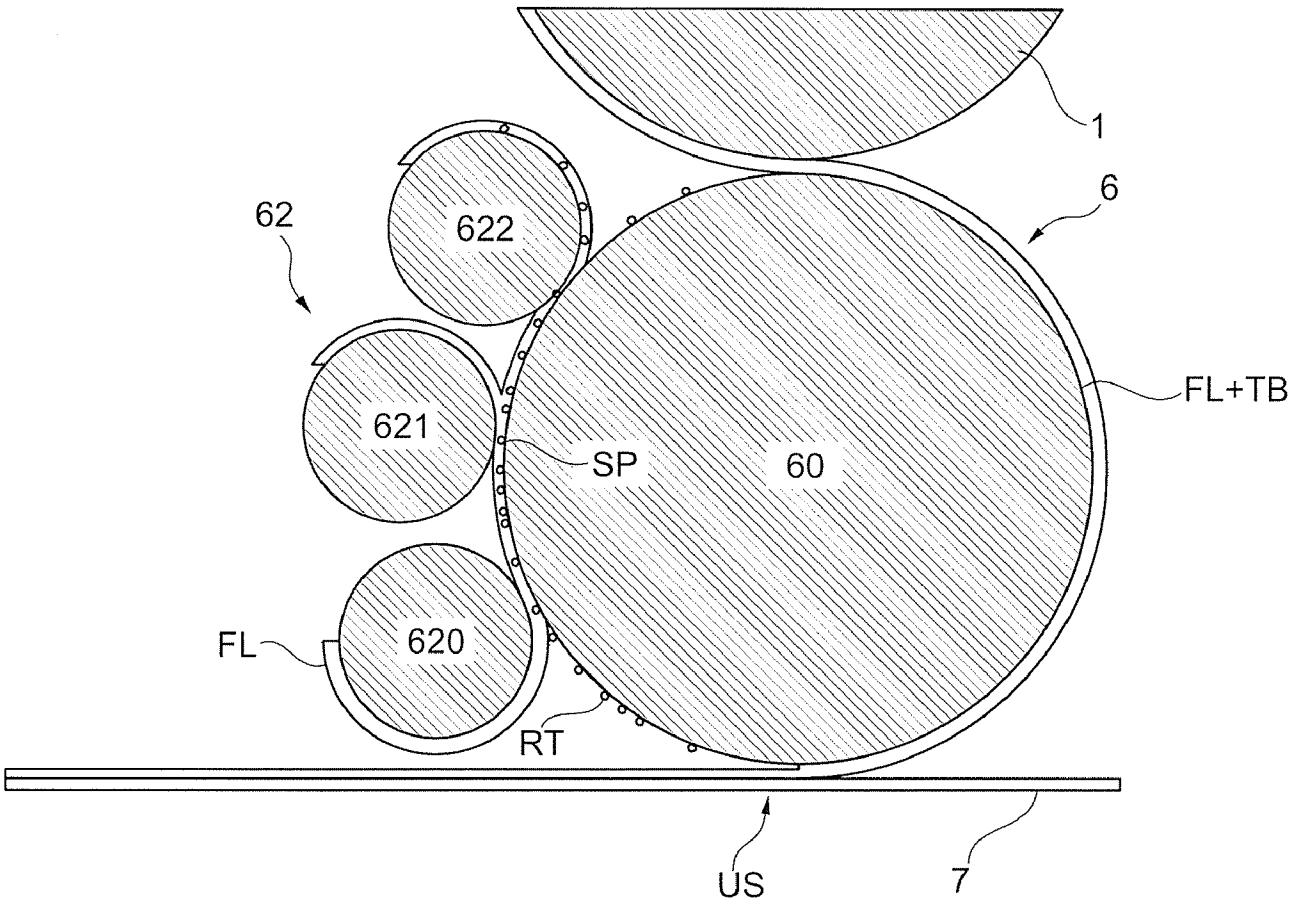
FIG. 2 illustrates a design of a transfer unit.

A section of the electrophoretic printing or copying apparatus DS according to FIG. 1 is shown in FIG. 2, namely the transfer unit 6 and the adjacently arranged charge image carrier 1. The transfer unit 6 has as a transfer element the transfer roller 60 (which is arranged adjacent to a charge carrier 1 realized as a photoconductor drum) and the cleaning unit 62. The cleaning unit 62 for its part has a scoop element 620, a friction element 621 and a cleaning element 622. The transfer element 60, the scoop element 620, the friction element 621 and the cleaning element 622 are respectively realized as rollers in FIG. 2; however, the preferred embodiment is not limited to these; these elements can also have a different form, for example be realized as bands. However, rollers are assumed in the following explanation of the preferred embodiment.

Additionally shown in FIG. 2 is the path of the toner image TB in the carrier fluid FL from the charge image carrier 1 to the transfer roller 60 and from there to the transfer printing point US of the transfer printing station.

The toner image is transferred at the transfer printing point US to the printing substrate 7. An unwanted residue of toner (the residual toner reception type RT of the residual toner image) which must be cleaned off of the transfer roller 60 thereby remains on the transfer roller 60. In order to improve the cleaning process, carrier fluid TF is transferred by the scoop roller 620 (arranged after the transfer printing point US) onto the surface of the transfer roller 60 and therefore also onto the residual toner RT. This residual toner RT can then be taken away from the transfer roller 60 by the cleaning roller 622. For this an electrical potential is applied to the cleaning roller 622, which potential is polarized such that electrical field forces act on the charged residual toner RT in the direction towards the cleaning roller 622, via which the residual toner RT is drawn towards the cleaning roller 622.

In a cleaning unit 62 that has only the scoop roller 620 and the cleaning roller 622, the problem exists that the residual toner RT is not completely cleaned from the transfer roller 60. In order to solve this problem, in the preferred embodiment a friction roller 621 is arranged between the scoop roller 620 and the cleaning roller 622, via which friction roller 621 a loosening of the residual toner RT on the transfer roller 60 is achieved. The friction roller 621 is arranged relative to the transfer roller 60 such that the gap SP between the friction roller 621 and the transfer roller 60 is completely filled with carrier fluid FL. The transfer roller 60 and the friction roller 621 rotate with different surface speeds (i.e. with a relative speed in relation to one another) so that the carrier fluid FL is accelerated between the two roller 60, 621; a speed gradient thus arises in the carrier fluid FL that generates a friction force on the surface of the transfer roller 60 via which the residual toner RT on the surface of the transfer roller 60 is loosened.

Figure 3:
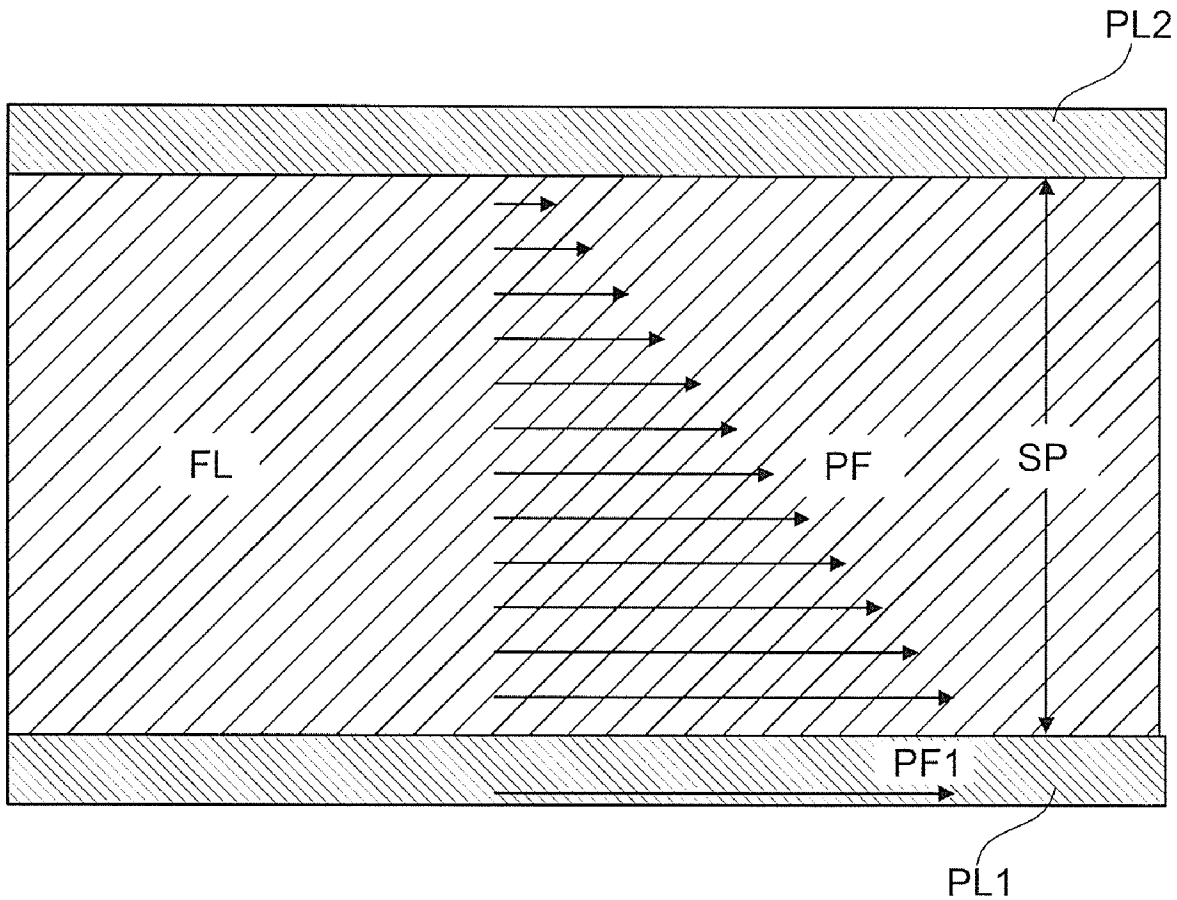
FIG. 3 illustrates a principle representation of the carrier fluid speed in the gap between the transfer element and the friction element.

The corresponding relationships are shown in FIG. 3, wherein the surfaces of the rollers 60, 621 are represented as flat plates PL1 and PL2 for explanation. In the example of FIG. 3 it is assumed that the surface speed of the plate PL1 (corresponding to the friction roller 621) is greater than that of the plate PL2 (corresponding to transfer roller 60); for example, the plate PL2 should be stationary and the plate PL1 should be moved with the speed (Arrow PF1). The arrows PF between the plates PL1 and PL2 show the different speeds of the carrier fluid FL at different points within the gap SP.

If the plate PL1 should be moved with a speed v, a force F is required according to the rule $$F=\eta A\Delta v/\Delta Z$$

$\eta$ is thereby the viscosity of the carrier fluid FL, A is the area of the plate PL1, $\Delta v$ is the speed difference of plates PL1 and PL2, and $\Delta z$ is the separation of the two plates PL1 and PL2 (corresponds to SP).

The force directed counter to the force F is the friction force that can act on the transfer roller 60 in order to loosen the residual toner RT adhering there. Care should thereby be taken that the friction roller 621 does not contact the transfer roller 60 anywhere or operation never occurs without carrier fluid FL situated between them, since otherwise the friction forces are too large or the principle no longer functions. The friction roller 621 should thus be narrower than the scoop region of the scoop roller 620. The friction roller 621 should additionally be wider than the inking region on the transfer roller 60 in order to be able to clean off the entire residual image there.

The function of the preferred embodiment is further explained using FIG. 2. Carrier fluid FL that should absorb the toner consolidation on the transfer roller 60 and transport it away is applied onto the transfer roller 60 with the scoop roller 620. After this the residual toner RT is loosened from the transfer roller 60 via the friction roller 621 due to the friction forces that are transferred through the carrier fluid film FL.

In a first exemplary embodiment, the residual image RT together with a portion of the carrier fluid FL are taken off by the cleaning roller 622. For this the electrical forces of the toner charge in an electrical field applied by the cleaning roller 622 are used in order to draw the residual toner RT towards the cleaning roller 622.

In a second exemplary embodiment, the friction roller 621 can also be set at an electrical potential in order for the friction roller 621 to already detach the loosened residual image RT. Only the residue of the carrier fluid FL with possible still-present residual toner must then still be disposed of by the cleaning roller 622. If the friction roller 621 revolves more quickly, this can take up a greater proportion of the carrier fluid FL and therefore also a greater portion of the residual image.

The surfaces of the transfer roller 60 and of the friction roller 621 can move in the same direction (with different surface speed) or in opposite directions (with the same or different surface speeds) in the gap SP. A relative speed between the transfer roller 60 and the friction roller 621 that generates the friction force results due to the different surface speeds.

While preferred embodiments have been illustrated and described in detail in the drawings and foregoing description, the same are to be considered as illustrative and not restrictive in character, it being understood that only the preferred embodiments have been shown and described and that all changes and modifications that come within the spirit of the invention both now or in the future are desired to be protected.

I claim as my invention:

1. A transfer unit for an electrophoretic printing or copying apparatus in which charge images of images to be printed are generated on a charge image carrier, said images being developed via liquid developer having carrier fluid and toner, and said images being transfer printed onto a printing substrate via the transfer unit in a transfer printing station, comprising:

a rotating transfer element arranged adjacent to the charge image carrier and that take the toner images from the charge image carrier and supplies the images to the transfer printing station;

a scoop element that applies carrier fluid to the transfer element, said scoop element being situated adjacent to the transfer element after the transfer printing station;

a friction element after the scoop element and adjacent to the transfer element at such a distance from the transfer element that a gap between the transfer element and the friction element is substantially completely filled with the carrier fluid, the friction element and the transfer element rotating with different speeds so that friction forces are transferred to the transfer element via the carrier fluid present between the friction element and the transfer element, and via said friction forces residual electrically charged toner remaining on the transfer element after the transfer printing is loosened;

the friction element is at such an electrical potential that the residual electrically charged loosened toner is drawn from the transfer element to the friction element; and a cleaning element arranged after the friction element adjacent to the transfer element, said cleaning element being at such an electrical potential that the residual electrically charged toner loosened by the friction element is drawn to the cleaning element.

2. A transfer unit according to claim 1 in which the friction element is at most as wide as the scoop element.

3. A transfer unit according to claim 1 in which the friction element is at least as wide as an inking region with toner on the transfer element.

4. A transfer unit according to claim 1 in which the transfer element is designed as a transfer roller.

5. A transfer unit according to claim 1 in which the friction element is designed as a friction roller.

6. A transfer unit according to claim 1 in which the scoop element is designed as a scoop roller.

7. A transfer unit according to claim 1 in which the cleaning element is designed as a cleaning roller.

8. A transfer unit for an electrophoretic printing or copying apparatus in which charge images of images to be printed are generated on a charge image carrier, said images being developed via liquid developer having carrier fluid and toner, and said images being transfer printed onto a printing substrate via the transfer unit in a transfer printing station, comprising:

a rotating transfer element comprising a roller arranged adjacent to the charge image carrier and that takes the toner images from the charge image carrier and supplies the images to the transfer printing station;

a scoop element comprising a roller that applies carrier fluid to the transfer element, said scoop element being situated adjacent to the transfer element after the transfer printing station;

a friction element comprising a roller after the scoop element and adjacent to the transfer element at such a distance from the transfer element that a gap between the transfer element and the friction element is substantially completely filled with carrier fluid, the friction element and the transfer element rotating with different speeds so that friction forces are transferred to the transfer element via the carrier fluid present between the friction element and the transfer element, and via said friction forces residual electrically charged toner remaining on the transfer element after the transfer printing is loosened; and a cleaning element comprising a roller arranged after the friction element adjacent to the transfer element, said cleaning element being at such an electrical potential that the residual electrically charged toner loosened by the friction element is drawn from a region near or at the transfer element to the cleaning element.

* * * * *